United States Patent [19]

Krasser et al.

[11] 4,024,487

[45] May 17, 1977

[54] MULTIPOLE EXCESS CURRENT SWITCH

[75] Inventors: Fritz Krasser; Josef Peter; Rainer Völkl, all of Altdorf, Germany

[73] Assignee: Ellenberger & Poensgen GmbH, Altdorf, Germany

[22] Filed: Feb. 10, 1976

[21] Appl. No.: 656,952

[30] Foreign Application Priority Data

Feb. 21, 1975 Germany ..... 2507454

[52] U.S. Cl. ..... 337/46; 337/50

[51] Int. Cl.² ..... H01H 73/30

[58] Field of Search ..... 337/42, 43, 45–48, 337/50, 66, 70; 335/8–10

[56] References Cited

UNITED STATES PATENTS

| | | | |
|---|---|---|---|
| 2,813,168 | 11/1957 | Mascioli et al. | 337/66 |
| 3,023,288 | 2/1962 | Bodenschatz et al. | 337/70 |
| 3,486,150 | 12/1969 | Clarke | 337/46 |
| 3,706,057 | 12/1972 | Ellenberger | 337/66 |

*Primary Examiner*—William H. Beha, Jr.
*Attorney, Agent, or Firm*—Spencer & Kaye

[57] ABSTRACT

A multipole excess current switch composed of a plurality of single pole excess current switches each arranged to be placed in series in a respective circuit to be protected, each single pole switch including a U-shaped bimetallic member connected to conduct the current through such circuit and to undergo a change in shape when conducting an excess current, and a spring loaded switching arrangement arranged to open the switch in response to movement of the bimetallic member, and the switching arrangements of all of the single pole switches being mechanically connected to trigger operation of the spring loaded switching arrangements of the other single pole switches when one of the switches opens in response to an excess current through its associated circuit. Advantageously, the U-shaped bimetallic member is composed of a plurality of bimetallic strips disposed adjacent one another, but separated from one another by insulating material, with each strip being provided with a slot that divides it into two legs and the strips being interconnected to place all of the legs of the several strips in series, thereby establishing a high resistance path that makes the bimetallic member responsive to low current levels.

11 Claims, 10 Drawing Figures

MULTIPOLE EXCESS CURRENT SWITCH

BACKGROUND OF THE INVENTION

The present invention relates to a multipole excess current switch of the type composed of a plurality of single pole excess current switches and a corresponding number of housings.

In such a multipole switch, only one of the single pole switches has the purpose of switching on and off a push button subjected to the action of a disconnection spring, the push button acting, via an operating rod rigidly connected therewith, on a shaft guided for transverse movement in the housing. An angle lever is rotatably mounted on the shaft and is subjected to the action of a release spring. The angle lever forms a bell crank together with a one-armed lever articulatedly connected to a contact bridge, the acticulation shaft of the one-armed lever being guided in grooves of the housing. A locking pawl is provided for arresting the shaft in the ON position of the contact bridge. A pivotally mounted release lever is provided for securing the angle lever against rotation when the switch is in the ON position, which release lever is pivotally urged into its ineffective position by a U-shaped bent bimetal strip.

The shaft extends into those single pole excess current switches which do not have push buttons, but each of which does have a bell crank composed of an angle lever rotatably mounted on the shaft and a one-armed lever, a contact bridge hinged to the one-armed lever, a released lever and a U-shaped bent bimetal strip acting thereon.

A multipole excess current switch of this kind is disclosed, for example, in U.S. Pat. No. 3,706,057, wherein the shafts of the release levers are coupled to one another, so that when an excess current occurs in one single pole excess current switch, all the release levers have to be pivoted by the one bimetal strip. In this universal-pole disconnection a relatively powerful force must therefore be exerted by the one bimetal strip.

SUMMARY OF THE INVENTION

It is an object of the present invention to overcome a number of the shortcomings of prior art systems of this type.

This and other objects according to the present invention are achieved by the provision of a multipole excess current switch composed of at least two single pole excess current switches ganged together, a common shaft extending through each of the switches and being movable relative to housings of the switches along guides provided in the housings, each single pole switch having an angle lever rotatably mounted on the shaft, a release spring connected to the angle lever, a one-armed lever coupled to the angle lever, a contact bridge articulatedly connected to the one armed-lever, an articulation shaft of the contact bridge being guided by further guides provided in the switch housing, a pivotally mounted release lever for securing the angle lever against rotation about the shaft when the switch is in its ON position, a U-shaped bent bimetal strip disposed to urge the release lever into its ineffective position upon the occurrence of an excess current, an auxiliary lever mounted to rotate about the same axis as the release lever and having a stop against which the release lever rests, when the switch is in its ON position, under the action of a further spring, and an actuating member mounted on the angle lever for urging the auxiliary lever together with the release lever to their ineffective positions, wherein the auxiliary levers of the single pole excess current switches are coupled to one another, and wherein one of the single pole excess current switches has a manually actuatable push button for switching the multipole switch on and off, a disconnection spring disposed to act on the push button, an operating rod rigidly connected with the push button and adapted to act on the common shaft, and a locking pawl for arresting the shaft in the ON position of the contact bridges.

When an excess current occurs in one single pole excess current switch of the multipole excess current switch in accordance with the invention, then the release lever is pivoted into its ineffective position by the bimetal strip of that single pole excess current switch. This release lever releases the associated angle lever so that the latter is pivoted under the action of the release spring. During this pivoting movement, pivoting of the auxiliary lever results by virtue of the actuating member of an angle lever, which actuating member may comprise a peg. As a result of the coupling together of all the auxiliary levers, the auxiliary levers of the other, remaining, single pole excess current switches as well as their release levers undergo a pivoting movement, causing tripping of all of the single pole excess current switching of the multipole excess current switch.

The multipole excess current switch in accordance with the invention thus has the advantage that it causes tripping of the single pole excess current switch in which the excess current occurs to be initiated by the the associated bimetal strip, and causes tripping of the remaining single pole excess current switches to be effected by the release spring of the single pole excess current switch in which the excess current occurs. Thus, for the purpose of universal-pole tripping of the multipole excess current switch, the bimetal strip of the single pole excess current switch need only exert as weak a force as is necessary for single pole tripping.

The U-shaped bent bimetal strip may consist of a number of mutually contacting, serially connected, directly heated, individual bimetal strips between which insulating material is provided. Such arrangements provide a greater short circuit stability of the bimetal strip than is obtained with a single bimetal strip.

It is already known as disclosed in German Auslegeschrift No 1,035,747, to arrange a plurality of planar bimetal strips to contact each other and to connect them in series. The U-shaped bent bimetal strip used in the switch in accordance with the present invention has the advantage over these known bimetal strips that, because of the U-shaped bend, it is longer and may, therefore, have a greater ohmic resistance.

An arm, preferably formed as a compensation bimetal strip, may be welded to each release lever, on which arm a plunger, actuatable by the bimetal strip and guided in the housing, acts at a point which is situated at a greater distance from the shaft than is a stop of the release lever. This offers the advantage that the force the bimetal strip needs to exert during its bending is reduced.

Each auxiliary lever may have a bent portion which extends obliquely to the direction of movement of the abutment of the angle lever. Easy actuation of the auxiliary lever and of the associated release lever is thereby obtained. Further facilitation of this actuation results from the fact that the U-shaped auxiliary levers have at their widely spaced legs two aligned pins situated at a relatively great distance from the shaft, proximate the stop of the release lever which secures the corresponding angle lever against rotation in the ON position, and from the fact that the pins of the auxiliary levers of all the single pole excess current switches are interconnected by coupling pieces. Since the auxiliary levers are mounted by means of their widely spaced legs and are interconnected at the pins by means of the coupling pieces, all the auxiliary levers can be readily pivoted in unison. As a result of the pins being disposed at a relatively great distance from the shaft, near the stop of the release lever, it is only necessary to overcome the friction, which is slight, between the stops of the release levers and the angle levers when the auxiliary levers and the release levers are pivoted.

The U-shaped bimetal strip may consist of two mutually contacting individual bimetal strips of which the inner individual bimetal strip has a closed slot and the outer individual bimetal strip has a slot which is eight open toward the affixing end or closed, the two individual bimetal strips being welded together at their free ends and an insulating material being interposed in the remaining portion between them. This bimetal strip which consists of two serially connected individual bimetal strips may be employed for nominal current intensities down to about 5 amperes.

For nominal current intensities of less than 5 amperes, the U-shaped bent bimetal strip may consist of three mutually contacting individual bimetal strips each of which has a slot open towards the affixing end, the end of one leg of the outer individual bimetal strip and the end of the oppositely situated leg of the inner individual bimetal strip forming the two external electrical connections. Those legs of the inner and the middle individual bimetal strips and of the outer and the middle individual bimetal strips which legs are adjacent the respective connections, are electrically and mechanically interconnected at their ends, preferably welded or soldered together, and in the remaining portion insulating material is provided between the three individual bimetal strips. In this event the three slotted individual bimetal strips are serially connected by their legs, so that a substantial resistance results wherefore these three individual bimetal strips can be heated by a relatively weak current.

In order to obtain in the single pole excess current switches which do not include a push button, a simple insulation of the shaft from the angle levers rotatably mounted thereon, the portion of the shaft in each of these single pole excess current switches having no push button may be provided with an insulating material which may, for example, consists of a shrink-fitted tube of a material resistant to high temperatures.

DESCRIPTION OF THE PREFERRED EMBODIMENTS

Figure 1:
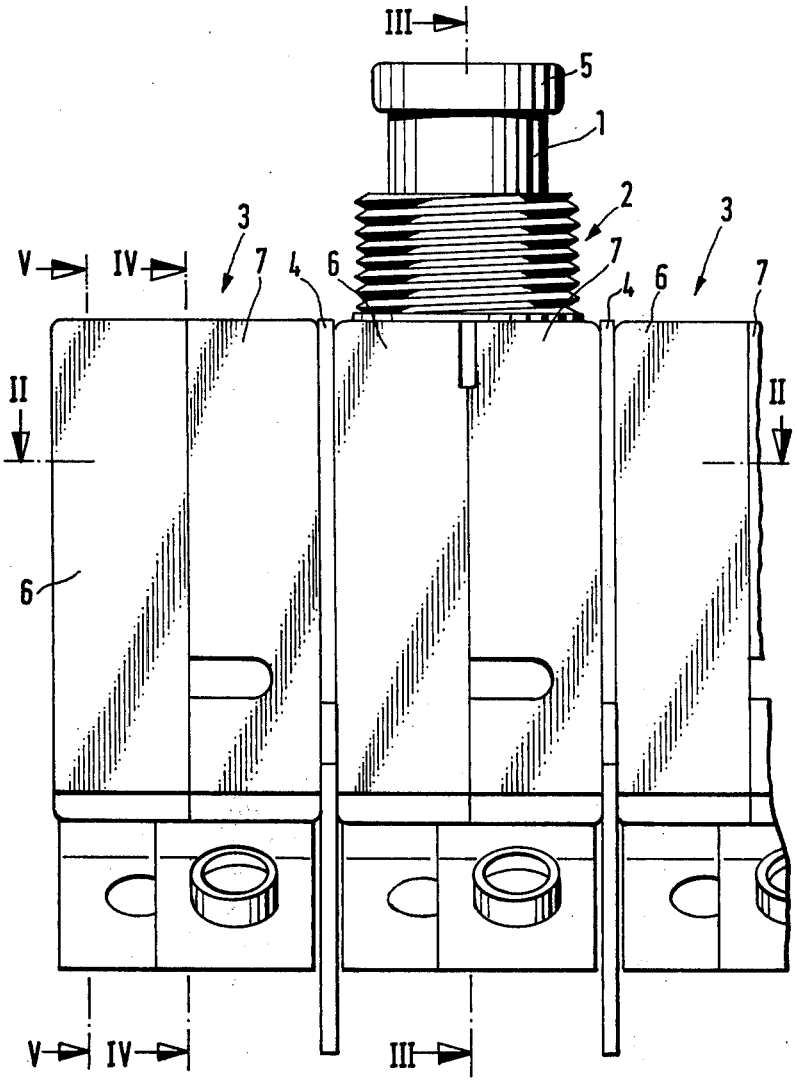
FIG. 1 is an elevational view of a triple pole excess current switch constituting one preferred embodiment of the invention.

The triple pole excess current switch shown in FIG. 1 is composed of a single pole excess current switch 2 provided with a push button 1 and substantially corresponding to the known single pole excess current switch disclosed in German Pat. No. 2,123,765, and two further single pole excess current switches 3 devoid of push buttons. Insulating plates 4 are disposed between switch 2 and switches 3. Since the push button 1 is used for switching on and off, it has at its upper end a thickened portion 5 which facilitates pulling of the push button 1 in the upward direction with reference to the orientation shown in FIG. 1.

Figure 3:
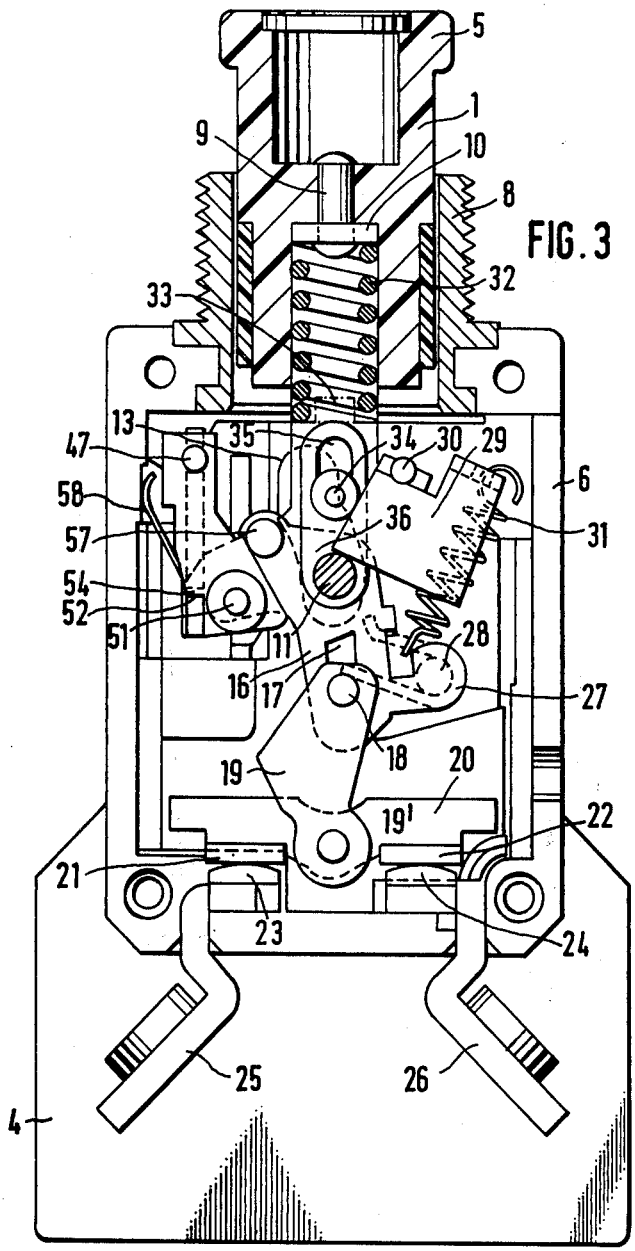
FIG. 3 is a cross-sectional view taken along the line III—III of FIG. 1.

Each of the single pole excess current switches 2 and 3 has a two-part housing consisting of the housing halves 6 and 7. As shown in FIG. 3, a sleeve 8 provided with an external thread is inserted in suitable recesses of the housing halves 6 and 7 of the central single pole excess current switch 2. The sleeve 8 serves for guiding the push button 1 and for mounting the three-pole excess current switch.

An L-shaped operating rod 10 is secured to the push button 1 by means of a rivet 9. The operating rod 10 may have at its lower end a recess with which it acts on a shaft 11. As is more particularly shown in FIG. 2, this shaft 11 extends through all three single pole excess current switches 2 and 3. A partitioning wall 12 of insulating material is inserted in suitable recesses formed in both housing halves 6 and 7. For the purpose of guiding the shaft 11, or passing it through walls 12, guidance slots or openings 13 are provided in these partitions 12 and in the housing halves 6 and 7. In the region of each outer single pole excess current switch 3, the shaft 11 is provided with a respective layer of insulation 14 or 15, which may consist of a shrink-fitted tube of a material resistant to high temperatures.

Figure 5:
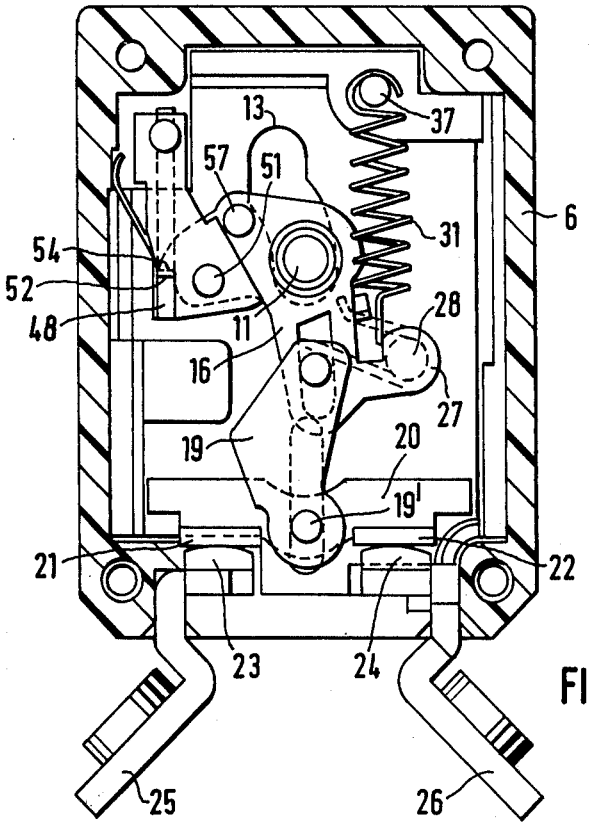
FIG. 5 is a cross-sectional view taken along line V—V of FIG. 1.

In each housing half 6 of the three single pole excess current switches 2 and 3, an angle lever 16 is pivotally mounted on the shaft 11. The lever 16 has a slot 17 in which engages a knee joint shaft 18 connected to a single-armed lever 19. An articulation shaft 19′ displaceably guided in vertical grooves of the two housing halves 6 and 7, as shown in FIG. 5, connects a contact bridge 20 with the single-armed lever 19. The contact bridge 20 carries two contact pieces 21 and 22 which, in the ON position of the switch, shown in FIG. 3, contact fixed counter-contact pieces 23 and 24. The fixed counter-contact pieces 23 and 24 are in electrical connection with terminals 25 and 26.

The contact pressure between pieces 21, 22 and 23, 24 is produced by a torsion spring 27 secured to a peg 28 of the angle lever 16, the spring 27 bearing with its upper arm on a bent portion of the angle lever 16 and thrusting with its lower arm against the knee joint shaft 18.

In the ON position shown in FIG. 3, the shaft 11 is arrested by a locking pawl 29 pivotally mounted in the housing of switch 2 on shafts 30 supported in the two housing halves 6 and 7. A release spring 31 engages with its upper end at the locking pawl 29 and with its lower end at the upper arm of the torsion spring 27.

The push button 1 is subjected to the action of disconnection spring 32 whose upper end is supported at the transverse leg of the L-shaped actuating rod 10 and whose lower end bears against the partition 12. The spring 32 encompasses a lug 33 of this partition 12.

To the operating rod 10 there is secured a pin 34 which engages into a slot 35 of a coupling lever 36 pivotally mounted on the shaft 11. In the region of the locking pawl 29, the operating rod 10 has at its right side with reference to the view of FIG. 3, a protuberance having an oblique surface whereby the operating rod, when in the ON position shown in FIG. 3, bears on a projection of the locking pawl 29.

FIG. 5 shows that the switching mechanism of the single pole excess current switch 3 also has a knee joint composed of an angle lever 16 and a one-armed lever 19, the joint connecting the shaft 11 with the contact bridge 20. The upper end of the release spring 31 is then secured to a lug 37 of the switch housing.

Figure 4:
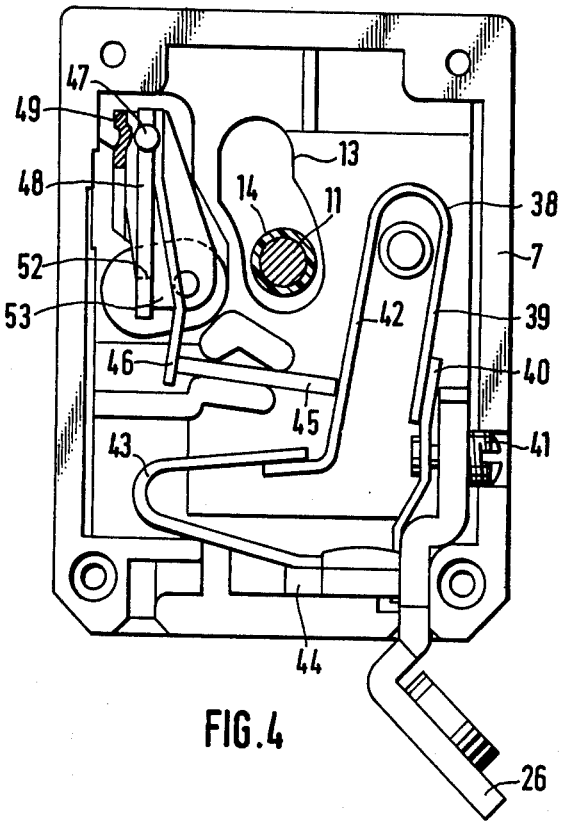
FIG. 4 is a cross-sectional view taken along line IV—IV of FIG. 1.

While in all cases the switching mechanism is located in the housing half 6, the thermal tripping means is disposed in the housing half 7. As shown in FIG. 4, the thermal tripping means has a U-shaped bimetal strip 38 the leg 39 of which is secured to a leaf spring 40 which is in electrical connection with the associated terminal 26. The position of the leaf spring 40, and thus of the leg 39, can be varied by means of an adjustment screw 41, whereby the intensity of the tripping current is set.

The other free leg 42 of the bimetal strip 38 is connected, by means of a stranded wire conductor 43, with a connection piece 44 projecting into the housing half 6 at the location where it carries the fixed counter-contact piece 24. When the bimetal strip 38 is heated, its leg 42 pivots in the clockwise sense. This movement of the leg 42 is transmitted, by means of a plunger 45 displaceably guided in the switch housing, to a compensation bimetal strip 46 which is secured, e.g., welded, to a release lever 48 pivotally mounted in the switch housing on a shaft 47.

Figure 6:
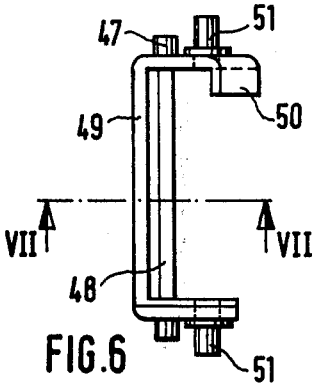
FIG. 6 is a plan view of an auxiliary lever with a release lever, being one component of the embodiment of FIGS. 1–5.
Figure 7:
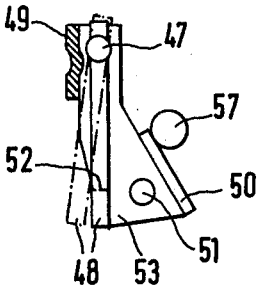
FIG. 7 is a cross-sectional view taken along line VII—VII of FIG. 6.

As is apparent from FIGS. 6 and 7 in particular, there is pivotally mounted on the shaft 47 an auxiliary lever 49 which is of U-shaped design and has a bent portion 50 at one leg. The two legs of the auxiliary lever 49 are provided with aligned pins 51 situated at a comparatively great distance from the shaft 47, near a stop 52 of the release lever 48. The auxiliary lever 49 further has a stop 53 against which the release lever 48 rests in the ON position. In the ON position, a retaining protuberance 54 of the angle lever 16 is supported at the stop 52 of the release lever 48.

Figure 2:
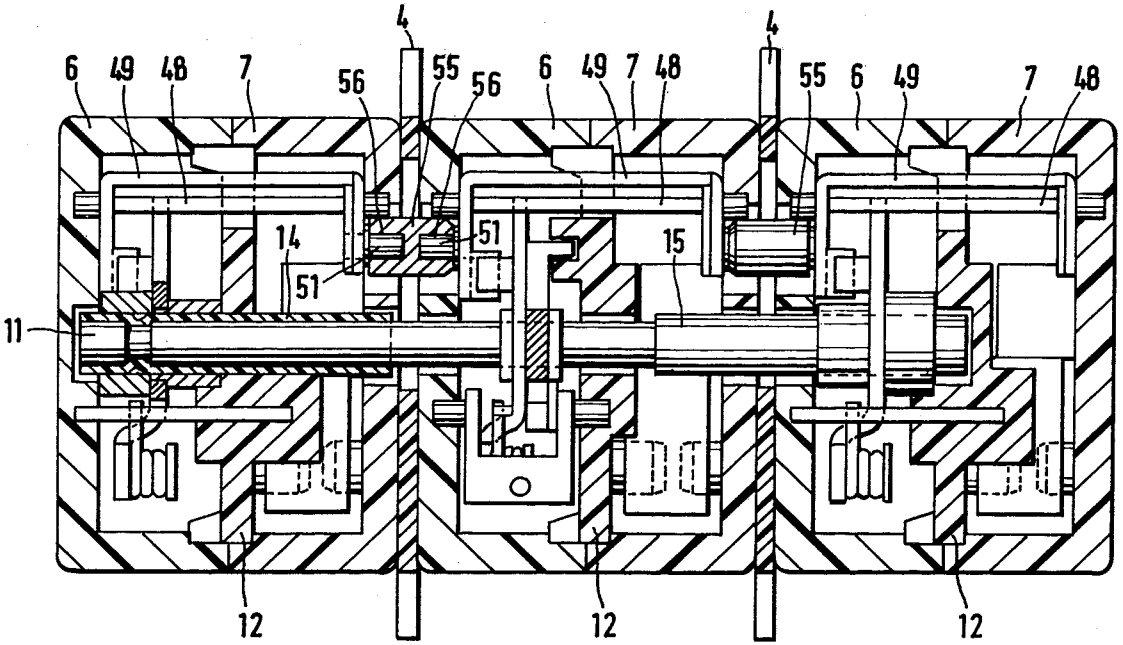
FIG. 2 is a cross-sectional view showing a section taken along line II—II of FIG. 1.

FIG. 2 shows that all the auxiliary levers 49 are connected by means of coupling pieces 55 made of insulating material. Each piece 55 has two aligned blind bores 56 into which the pins 51 of respective auxiliary levers 49 engage, so that all levers 49 will pivot together. Each angle lever 16 of each of the single pole excess current switches 2 and 3 has an actuating member in the form of a peg 57 adapted to cooperate with the bent portion 50 of the auxiliary lever 49, the bent portion forming a sloping surface. In the ON position shown in FIG. 3, the auxiliary lever 49 contacts the peg 57 and is subjected to the action of a tensioned leaf spring 58 secured to the release lever 48.

Figure 8:
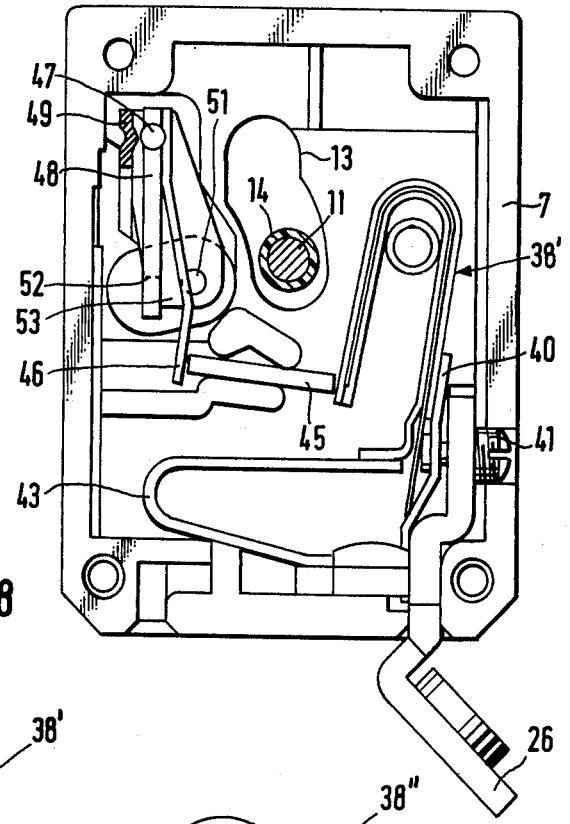
FIG. 8 is a view similar to that of FIG. 4, but showing a modified embodiment containing a bimetal strip consisting of two mutually contacting individual bimetal strips.
Figure 9:
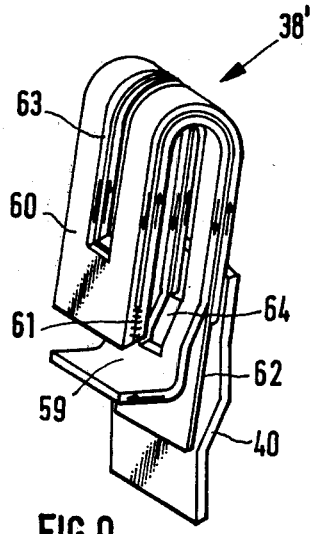
FIG. 9 is a perspective view of the bimetal strip of FIG. 8.

Referring to FIGS. 8 and 9, the illustrated bimetal strip 38' is composed of two individual bimetal strips 59 and 60 which are welded together only at their free ends at 61 and are otherwise electrically separated by an insulating layer 62. The outer individual bimetal strip 60 has a slot 63 which is open towards the affixing end and the inner individual bimetal strip 59 has a closed slot 64, i.e., both ends of the slot are closed. Thus, the two individual bimetal strips 59 and 60 are connected together, in series by being welded at 61. The slot 63 may, of course, alternatively be closed.

Figure 10:
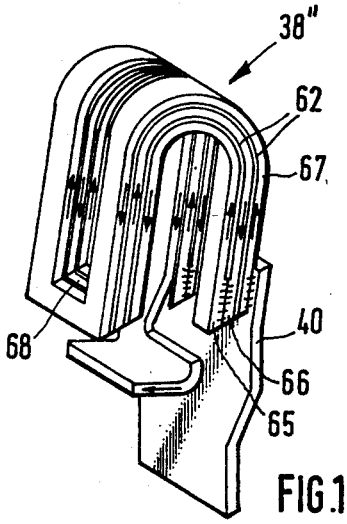
FIG. 10 is a perspective view, similar to that of FIG. 9, of a bimetal strip consisting of three individual bimetal strips.

The alternate bimetal strip structure 38'' shown in FIG. 10 consists of three individual bimetal strips 65, 66 and 67 each of which has a slot 68 which is open towards the affixing end to divide each strip into two legs. One leg of the bimetal strip 67 is welded to the leaf spring 40. The ends of the two legs of the individual bimetal strips 65 and 66 which are adjacent the one leg of strip 67 are welded together. Furthermore, the other legs of the two individual bimetal strips 66 and 67 are welded together. Between the individual bimetal strips 65, 66 and 67 there are disposed insulating layers 62. In this manner, all the individual bimetal strips 65, 66 and 67 are serially connected by their legs, so that this bimetal strip 38'' of FIG. 10 has a high resistance and can be heated by a relatively weak current.

The illustrated multipole excess current switch operates in the following manner:

When, in the ON position of the excess current switch, as shown in FIGS. 3 to 5 and 8, an excess current occurs in all three single pole excess current switches 2 and 3, the movable arms 42 of the bimetal strips 38' are pivoted in the clockwise sense so that the plungers 45 pivot the compensation bimetal strips, and thus the release levers 48, in the clockwise sense, whereby the stops 52 of the release levers 48 release the angle levers 16 at their retaining protuberances 54, so that all of the angle levers 16 pivot in the counterclockwise sense about the shaft 11, under the action of the release springs 31.

The bell cranks formed by the angle levers 16 and the one armed levers 19 thereby bend in and the one-armed levers 19 lift the contact bridges 20 with their contact pieces 21 and 22 off the fixed counter-contact pieces 23 and 24, whereby the current circuits in all the single pole excess current switches are interrupted. Since the release spring 31 of the central single pole excess current switch 2 is thereby relaxed, the disconnection spring 32 can move the push button 1 and the operating rod 10 upwardly into the OFF position, because the projection, not shown, on the operating rod acts with its sloping surface against the corresponding protuberance of the locking pawl 29 and swings this locking pawl 29 out of the range of movement of the shaft 11.

When, in the ON position of the multipole excess current switch, an excess current occurs only in a single one of the single pole excess current switches 2 and 3, then, in that switch, the bimetal strip 38 or 38' swings the release lever 48, via the plunger 45 and the compensation bimetal strip 46, into its ineffective position, so that the corresponding angle lever 16 is released at the retaining protuberance 54 and is pivoted in the counter-clockwise sense by the release spring 31. Simultaneously, the peg 57 of the angle lever 16 acts on the bent portion 50 of the auxiliary lever 49 so that all the coupled auxiliary levers 49, and with them the associated release levers 48, are pivoted in the clockwise sense and thereby all of the angle levers 16 are freed to pivot counter-clockwise under the action of the release springs 31, whereby, all of the single pole excess current switches arrive at their OFF positions. Such tripping can also result when the push button 1 is constrained in its ON position shown in FIG. 3, this being a trip-free release.

When, in the ON position shown in FIG. 3, the push button 1 is pulled upward, then the push button 1 with its operating rod 10 can unimpededly move upwardly by virtue of the slot 35, the projection of the operating rod which is provided with a sloping surface thrusting against the corresponding protuberance of the locking pawl 29, so that the locking pawl 29 is swung out of the range of movement of the shaft 11. Since the shaft 11 can now move upwardly, the one-armed lever 19 with the contact bridge 20 is moved upwardy and its contact pieces 21 and 22 are lifted off the fixed counter-contact pieces 23 and 24. This manual tripping occurs in all the single pole excess current switches since the shaft 11 extends over all the single pole excess current switches and this shaft 11 is only latched in the central single pole excess current switch.

After such tripping, the multipole excess current switch can be brought into the ON position by depressing the push button 1. When this is done the retaining protuberances 54 of the angle levers 16 first come to rest against the stops 52 of the release levers 48. Upon continued pressure on the push button 1, all the angle levers 16 are pivoted in the clockwise sense by the shaft 11. The contact pieces 21 and 22 of the contact bridge 20 thereby come into contact at the fixed counter-contact pieces 23 and 24. In this ON position, the shaft 11 is then arrested by the locking pawl 29. Each torsion spring 27 hereby produces the contact pressure between the contact pieces 21 and 22 and the fixed counter-contact pieces 23, 24 of its respective single pole switch.

It will be understood that the above description of the present invention is susceptible to various modifications, changes and adaptations, and the same are intended to be comprehended within the meaning and range of equivalents of the appended claims.

What is claimed is:

1. A multipole excess current switch assembly comprising:

at least two single pole excess current switches ganged together to open simultaneously; at least two housings each enclosing a respective switch; first and second guides provided in said housings; a common shaft extending through each of said switches and movable relative to said housings along said first guides; wherein each said switch comprises: an angle lever rotatably mounted on said shaft; a release spring connected to said angle lever; a one-armed lever coupled to said angle lever; a contact bridge articulatedly connected to said one-armed lever and including an articulation shaft guided by said second guide in its respective housing; a pivotally mounted release lever mounted for securing said angle lever against rotational movement about said shaft when said switch is in its ON position; a U-shaped bent bimetal strip arranged for urging said release lever into an ineffective position upon the occurrence of an excess current; a further spring; an auxiliary lever connected to said further spring and mounted to rotate about the same axis as said release lever and having a stop against which said release lever rests, when said switch is in its ON position under the action of said further spring; and an actuating member mounted on said angle lever for urging said auxiliary lever together with said release lever to their ineffective positions;

wherein said assembly further comprises: means connecting together said auxiliary levers of all of said switches; and wherein one of said switches further comprises: a manually actuatable push button operatively connected to one of said switches for manually switching said assembly on and off; a disconnection spring disposed to act on said push button; an operating rod rigidly connected with said push button and arranged to act on said common shaft; and a locking pawl arranged for arresting said shaft with said contact bridges in the position corresponding to the ON position of said switches.

2. A switch as defined in claim 1 wherein said release spring of said one of said switches is also connected to said locking pawl, and said release spring of each other switch is also connected to said housing of its respective switch.

3. A switch as defined in claim 2 wherein said release lever of each said switch is provided with a stop and each said switch further comprises: an arm secured to said release lever; and a plunger guided in said housing and actuatable by said bimetal strip to act on said arm at a point which is at a greater distance from said shaft than is said stop of said release lever.

4. A switch as defined in claim 3, wherein, in each said switch, said arm is formed as a compensation bimetal strip.

5. A switch as defined in claim 4 wherein, in each said switch said angle lever is provided with a peg and said auxiliary lever has a bent portion which extends obliquely to the direction of movement of said peg during pivotal movement of said angle lever.

6. A switch as defined in claim 5 wherein each said auxiliary lever has a U-shape and is constituted by two legs which are spaced from each other and which each carries a respective pin, said two pins being aligned and being situated at a relatively great distance from said shaft, and said stop of said release lever is near the axis of said pins and secures the corresponding angle lever, in the ON position of said switch, against rotation; and further comprising coupling means interconnecting said pins of all of said single pole switches.

7. A switch as defined in clain 1 wherein said U-shaped bent bimetal strip comprises a plurality of mutually contacting, serially connected, directly heated, individual bimetal strips, and insulating material interposed between adjacent pairs of said individual strips.

8. A switch as defined in claim 7 wherein said U-shaped bent bimetal strip comprises two mutually contacting individual bimetal strips with the inner individual bimetal strip having a closed slot and the outer individual bimetal strip having a slot extending along at least a portion of its length, and wherein said two individual bimetal strips are welded together at their free ends and said insulating material is provided between them over the remaining portion of their length.

9. A switch as defined in claim 7 wherein said U-shaped bet bimetal strip comprises three mutually contacting individual bimetal strips each of which has a slot open towards an affixing end, the end of one leg of the outermost individual bimetal strip and the end of the oppositely situated leg of the innermost individual bimetal strip form two external electric terminals for conducting current through said strip, the legs adjacent each terminal of the innermost and the central individual bimetal strip and of the outermost and the central individual bimetal strip are electrically and mechanically interconnected at their ends, and said insulating material is provided between adjacent pairs of said three individual bimetal strips, in the region outside of the locations where they are interconnected.

10. A switch as defined in claim 1 further comprising a body of insulating material associated with each said switch which is not provided with a push button and mounted on said shaft.

11. A switch as defined in claim 10 wherein each said body of insulating material comprises a shrink-fitted tube of a material which is resistant to elevated temperatures mounted on a respective length of said shaft.

* * * * *